United States Patent [19]

Nagai

[11] 4,016,848

[45] Apr. 12, 1977

[54] AIR-VENT SYSTEM FOR A CARBURETOR

[75] Inventor: Takanori Nagai, Toyota, Japan

[73] Assignee: Toyota Jidosha Kogyo Kabushiki Kaisha, Toyota, Japan

[22] Filed: May 29, 1975

[21] Appl. No.: 581,732

[30] Foreign Application Priority Data

Jan. 31, 1975 Japan ..... 50-13014

[52] U.S. Cl. ..... 123/136; 261/DIG. 67

[51] Int. Cl.[2] ..... F02M 37/00

[58] Field of Search ..... 123/136, 119 A; 60/278; 251/63; 261/72 R, DIG. 67

[56] References Cited

UNITED STATES PATENTS

| | | | |
|---|---|---|---|
| 1,361,581 | 12/1920 | Hibner | 251/63 |
| 1,647,826 | 11/1927 | Feeley et al. | 251/63 |
| 2,589,794 | 3/1952 | Frantz | 251/63 X |
| 3,548,797 | 12/1970 | Hagihara et al. | 123/136 |
| 3,683,597 | 8/1972 | Beveridge et al. | 123/136 X |
| 3,796,049 | 3/1974 | Hayashi | 60/278 |

*Primary Examiner*—C. J. Husar
*Assistant Examiner*—Tony M. Argenbright
*Attorney, Agent, or Firm*—Birch, Stewart, Kolasch and Birch

[57] ABSTRACT

An air-vent system for a carburetor which selectively opens an outer vent of a float chamber to a fuel vapour adsorptive vessel under the control of a control valve which is normally opened by a spring force and is closed by air pressure delivered from an air pump driven by an engine when the engine rotational speed increases beyond a predetermined level.

3 Claims, 1 Drawing Figure

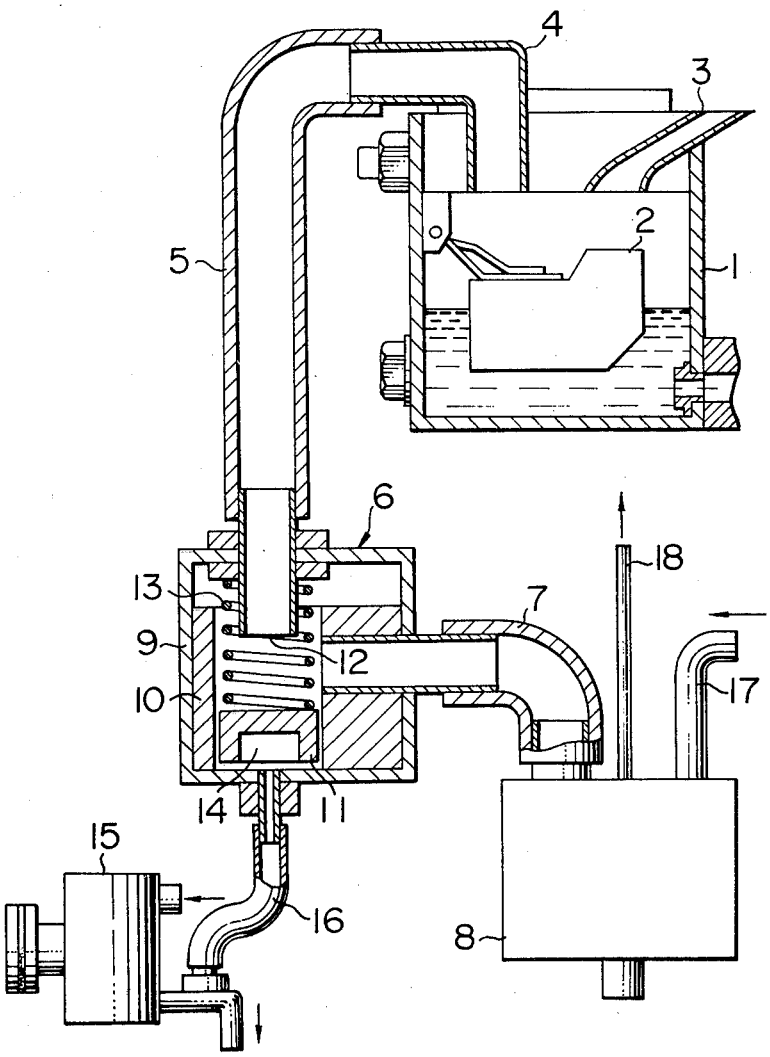
4
3
2
5
1
6
18
13
7
9
12
17
10
14
11
15
16
8

AIR-VENT SYSTEM FOR A CARBURETOR

BACKGROUND OF THE INVENTION

1. Field of the Invention

The present invention generally relates to a carburetor and, more particularly, an air-vent system for a carburetor.

2. Description of the Prior Art

Vapour of fuel generated in a float chamber of a carburetor is generally taken out from the float chamber through a conduit means called an 'inner vent' and is led to an inlet portion of the carburetor, i.e. an outlet chamber space of an air cleaner to be mixed with the suction air of an engine. However, in view of an inconvenience that the excessively rich fuel-air mixture is generated at the inlet portion of the carburetor if a large amount of fuel vapour is exhausted toward the outlet chamber space of the air cleaner during stoppage of the engine, the float chamber is generally provided with an outer vent which also opens thereto, said outer vent being connected to a fuel vapour adsorptive vessel like a charcoal canister by a conduit thereby providing for the fuel vapour which is principally generated during stoppage of the engine, to be captured by adsorption. The fuel vapour adsorptive vessel is connected to a purge port which opens to a suction air passage in the carburetor at a position downstream of a throttle valve when it is opened, whereby the fuel held by adsorption in said fuel vapour adsorptive vessel is released from an adsorptive like charcoal when vacuum is applied to said vessel from said purge port during operation of the engine, to be mixed in fuel-air mixture supplied to the engine. The vent passage which extends from said outer vent to said fuel vapour adsorptive vessel is to be opened only when the engine is stopped and, advantageously when the engine is making an idling operation, while it must be closed when the engine is operating with a load higher than an idling operation. Therefore, a control valve is provided in a conduit which connects said outer vent to said fuel vapour adsorptive vessel, said control valve being adapted to selectively intercept said conduit. Conventionally, said control valve is constituted as an electromagnetic valve or a mechanically operated valve. In the former type, the valve is generally interconnected with a key switch of the engine so that the valve is closed when the key switch is closed while the valve is opened when the key switch is opened. The mechanically operated valve is generally interconnected with the throttle valve so that the valve is opened when the throttle valve is in its closed position while the valve is closed when the throttle valve is opened. However, the system employing the electromagnetic valve has the drawback that it is expensive and, furthermore, the control valve is closed to shut down the operation of the outer vent system when the engine is idling, although it is at that time that it is required that the outer vent system operate. This is because the fuel vapour generated in the float chamber causes an excessively rich fuel-air mixture if all of the vapour is exhausted through the inner vent system and mixed with a relatively small amount of suction air during the idling operation of the engine. The control valve which is operated by mechanical interrelation with the throttle valve has the drawback that the structure is complicated with poor durability and poor accuracy in control.

SUMMARY OF THE INVENTION

It is the object of the present invention to solve the abovementioned problems in the conventional air-vent systems for a carbureter and to provide an improved air-vent system for a carburetor.

Other objects and further scope of applicability of the present invention will become apparent from the detailed description given hereinafter; it should be understood, however, that the detailed description and specific examples, while indicating preferred embodiments of the present invention, are given by way of illustration only, since various changes and modifications within the spirit and scope of the invention will become apparent to those skilled in the art from this detailed description.

According to the present invention, the abovementioned object is accomplished by providing an air-vent system for a carburetor, comprising an outer vent which opens to a float chamber of said carburetor, a fuel vapour adsorptive vessel, for example, a charcoal canister, a conduit which connects said outer vent to said fuel vapour adsorptive vessel and a control valve provided in said conduit to selectively intercept the flow through said conduit. The control valve comprises a valve element which is biassed by a spring toward a valve opening position and is adapted to be driven by the air pressure of an air pump driven by an engine toward a valve closing position against the action of said spring.

An automobile is generally equipped with an air pump which is driven by its engine for the purpose of exhaust gas purification. The delivery air pressure of the air pump increases generally in proportion to the rotational speed of the engine. Therefore, by the constitution of the control valve wherein the valve element is biassed by a spring toward a valve opening position and is driven by the delivery air pressure of the air pump toward a valve closing position against the action of the spring, the control valve is adapted to open or close according to the rotational speed of the engine, with an optional setting of the rotational speed below which the valve is opened. Thus, an air-vent system for a carburetor which operates in a favourable manner in accordance with the operational condition of the engine is obtained.

Said valve element may be an optional displacing element like a diaphragm or a piston which is actuated by air pressure. Since a high air tightness is not required for the closing performance of the control valve as far as it does not affect the air tightness of the vent passage extending from the outer vent to the fuel vapour adsorptive vessel, the control valve may have the structure of an air pressure operated valve of the cylinder-piston type which comprises a piston valve element which is received in a cylinder enclosed in an air tight housing by relatively loose engagement therewith and to be reciprocable therein.

BRIEF DESCRIPTION OF THE DRAWING

The attached FIGURE is a cross sectional view of an embodiment of the air-vent system for a carburetor according to the present invention.

DESCRIPTION OF THE PREFERRED EMBODIMENT

Referring to the figure, element 1 designates a float chamber of a carburetor, in which a float 2 is provided.

Element 3 designates an inner vent which leads fuel vapour generated in the float chamber 1 to an outlet chamber space of an air cleaner (not shown). An outer vent 4 also opens to the float chamber 1, said outer vent being connected to a conduit 5, a control valve 6, a conduit 7 and finally to a fuel vapour adsorptive vessel 8 like a charcoal canister.

The control valve 6 comprises an air-tight housing 9, in which is incorporated a valve structure composed of a cylinder element 10, a piston valve element 11 and a valve port 12 adapted to be selectively opened or closed by said valve element. The valve element 11 is applied with a resilient compression force which acts downward as seen in the figure by a compression coil spring 13. The valve element 11 is driven upward against the action of the spring 13 when a cylinder chamber 14 disposed below the valve element is supplied with air pressure generated by an air pump 15 through a conduit 16, said air pump being driven by a crank shaft of an engine (not shown). When the engine is not operating or operating at a very low speed, for example idling, the air pressure supplied to the cylinder chamber 14 is below a predetermined level, whereby the valve element 11 is biassed downward by the action of the compression coil spring 13 to open the valve port 12 thereby opening the outer vent 4 to the fuel vapour adsorptive vessel 8. By contrast, when the rotational speed of the engine has increased beyond a predetermined value so that the air pressure supplied to the cylinder chamber 14 increases beyond a predetermined level, the valve element 11 is urged against the valve port 12 against the action of the compression coil spring 13 to close the valve port thereby interrupting the connection between the outer vent 4 and the fuel vapour adsorptive vessel 8.

The fuel vapour adsorptive vessel 8 is further connected with a fuel vapour conduit 17 which is led from a fuel tank. Furthermore, a conduit 18 is led out from the fuel vapour adsorptive vessel 8 toward a purge port (not shown) which opens to a suction air passage of the carburetor to transfer fuel adsorbed by an adsorptive like charcoal charged in the fuel vapour adsorptive vessel 8 into the suction air supplied to the engine. Said purge port is provided to open to said suction air passage at a position which is located upstream of a throttle valve when it is closed while it is located downstream of the throttle valve when it is opened. By this arrangement, the purge port does not apply any vacuum to the fuel vapour adsorptive vessel 8 when the engine is stopped or idling while it applies an intake manifold vacuum to the fuel vapour adsorptive vessel through the conduit 18 when the throttle valve is opened to effect the load carrying operation of the engine. In the latter condition, the fuel adsorbed by the adsorptive like charcoal is released therefrom and introduced into the suction air.

Although the particular embodiment shown incorporates a control valve 6 of the piston type, it will be apparent that various modifications can be made with regard to the shown embodiment without departing from the spirit and scope of the invention.

I claim:

1. A vent system for a float chamber of a carburetor comprising a carburetor housing portion defining a float chamber therein, a vent port provided in said housing portion, a fuel vapour absorptive vessel-like charcoal cannister having inlet and outlet ports, a control valve having inlet and outlet ports, a first passage means which connects said vent port to said inlet port of said control valve, a second passage means which connects said outlet port of said control valve to said inlet port of said fuel vapour adsorptive vessel, and an air pump provided with a delivery port and driven by an associated engine which operates with said carburetor, said control valve defining a through passage therein which connects said inlet and outlet ports thereof and having a valve element which selectively tranverses said through passage to substantially intercept said through passage, an air chamber means which is connected with the delivery port of said air pump and biases said valve element to traverse and close said through passage when it is supplied with air pressure above a predetermined level, and a spring means which biases said valve element toward an open position to counter-act said air chamber means.

2. The system of claim 1, wherein said control valve comprises an air tight housing and a cylinder bore means which is confined in said housing and forms a part of said through passage, and that said valve element is a piston member relatively loosely received in said cylinder bore means, said cylinder bore means also forming a part of said air chamber means.

3. The system of claim 2, wherein said through passage includes a first port which faces an end wall of said piston member to be selectively closed by said end wall of said piston member and a second port which is traversed by a side wall of said piston member to be selectively closed by said side wall of said piston member.

* * * * *